United States Patent [19]

Paton et al.

[11] Patent Number: 4,874,120

[45] Date of Patent: Oct. 17, 1989

[54] CARGO TRANSPORTING CARRIER

[76] Inventors: Eric R. Paton; William U. Cooley, both of 2635 Beland, Redondo Beach, Calif. 90278

[21] Appl. No.: 933,983

[22] Filed: Nov. 24, 1986

[51] Int. Cl.[4] ..... A63C 15/06; A45F 5/00

[52] U.S. Cl. ..... 224/266; 114/39.1; 114/343; 224/181; 224/242

[58] Field of Search ..... 224/917, 181, 186, 187, 224/188, 189, 190, 201, 209, 210, 215, 242, 265, 266, 270, 271; 114/343, 39, 39.1, 39.2; 441/74

[56] References Cited

U.S. PATENT DOCUMENTS

| | | | |
|---|---|---|---|
| 481,481 | 8/1892 | Devereaux | 224/189 X |
| 3,021,985 | 2/1962 | Sarver | 224/187 |
| 3,257,052 | 6/1966 | McMiller | 224/917 X |
| 3,325,069 | 6/1967 | Fulton | 224/917 X |
| 3,547,322 | 12/1970 | Dawson et al. | 224/265 X |
| 4,649,846 | 3/1987 | Javanelle | 224/181 |

FOREIGN PATENT DOCUMENTS

| | | | |
|---|---|---|---|
| 3046951 | 7/1982 | Fed. Rep. of Germany | 224/917 |
| 2481209 | 10/1981 | France | 224/917 |

*Primary Examiner*—Ernest G. Cusick
*Attorney, Agent, or Firm*—John E. Halamka

[57] ABSTRACT

An improved cargo carrying arrangement particularly adapted to carry a sailboard and related equipment. A horizontal cargo bed is vertically supported above the user's head. The vertical supports are attached to curved shoulder supports. Padding is provided on the top of the cargo bed and under the shoulder supports. Handles are mounted on the front vertical supports within reach of the user to be used to steady the load. A strap is provided to tie the cargo to the bed. The vertical supports may be hinged to the bed to allow the arrangement to be folded for storage.

14 Claims, 2 Drawing Sheets

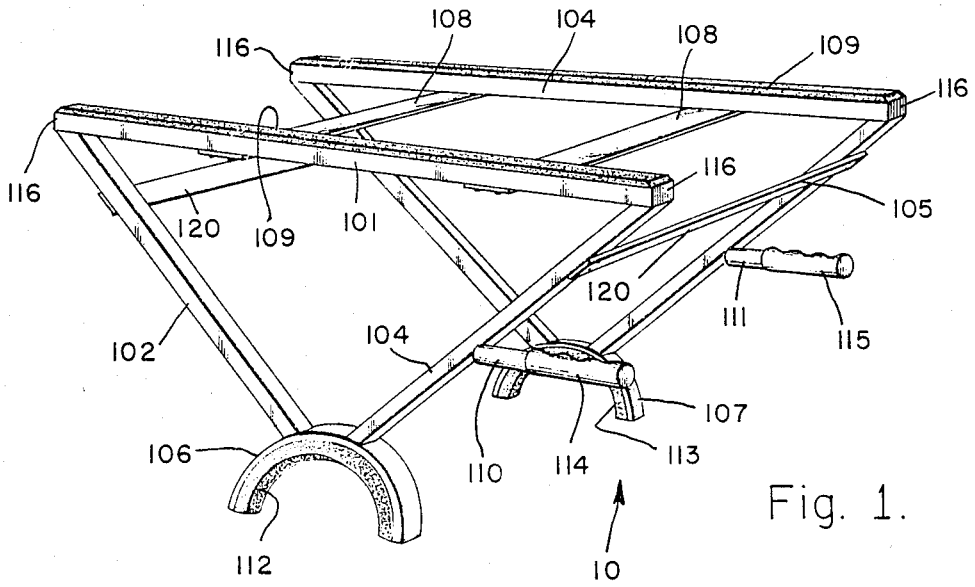
Fig. 1.
Fig. 2.
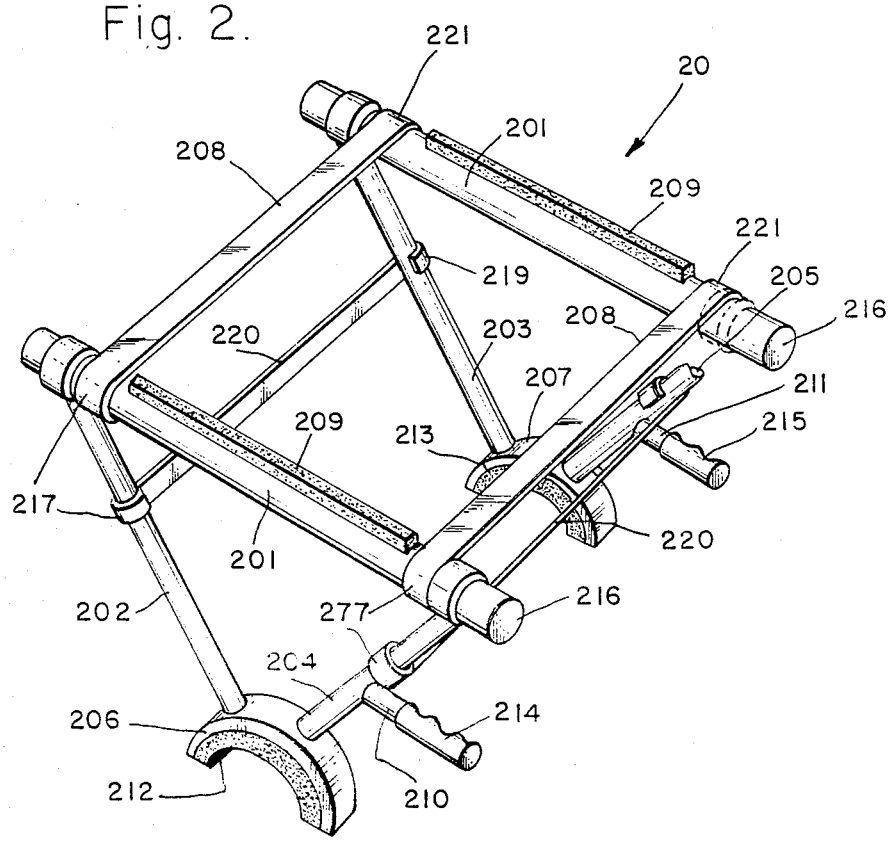

CARGO TRANSPORTING CARRIER

BACKGROUND OF THE INVENTION

1. Field of the Invention

This invention relates to the art of carrying cargo and more particularly to the carrying of a sailboard and related equipment (sale, mast, boom) sail from a stowed away location to the shoreline.

2. Description of the Prior Art

Backpacks of various designs and configurations are commonly used by hikers. The backpack load is usually mounted vertically along the backside of the carrier. The vertical mounting limits the length of cargo that may be carried especially down steep slopes common near the shore.

The vertical mounting of a long, broad, flat object such as a sailboard is not prevalent because of the weight (40 pounds) and length of the sailboard. Further, such vertical mounting engages the prevailing wind and may result in the application of an uncontrollable rotational force on the sailboard which the user may not be able to safely control.

Present practice is to carry the sailboard during the first trip, then return for the remainder of the equipment for a second trip. Attempting to carry the entire package at one time is difficult because the added weight and ungainliness of the sail, mast and boom creates a package which is awkward to control. More control is available by carrying the package above the head. However, the weight of the package quickly tiers the arms and the package usually come to rest upon the head. The weight of the package on the head also limits ones ability to move ones head to safely navigate.

Some attempts to solve the problem have been made. One attempt uses a strap to bundle the implements into one package. The strap is then slung over one shoulder to carry the load along the opposite side of the body. This arrangement does not distribute the weight evenly and quickly tires the one shoulder.

Another attempt to solve the problem introduces a carriage with large wheels to be tied to one end of the package. This device does not solve the problem of negotiating steps, cliffs, soft sand, etc. Further, the size of the frame and wheels create a storage and transportation problem for the device itself.

Thus, there has long been a need for an arrangement to carry a sailboard and its implements. It is desired that the carrying position of the sailboard be horizontal to reduce wind loading.

Further, it is desired that the position of the package on the body not interfere with negotiating steep terrain yet be in a position accessible to the arms to compensate for rotational forces.

Additionally, it is desired that the weight of the package be symmetrically distributed on the body for ease of carrying and control.

SUMMARY OF THE INVENTION

Accordingly, it is an object of the present invention to provide an improved carrier for long, broad cargo such as a sailboard and it implements.

It is another object of the present invention to to provide an improved carrier which may be positioned to apply the load to the both of the user's shoulders instead of the top of the head and arms yet place the sailboard in a well balanced substantially horizontal position.

It is yet another object of the present invention provide an improved carrier which may be positioned within easy reach of the users arms to compensate for any shifting of the load and external forces applied to the load.

The above and other objects of the present invention are achieved, according to a preferred embodiment thereof, by providing a carrier frame fabricated of light weight rigid material. Such material may include tubing or other stock formed from aluminum, polyvinyl chloride, wound carbon filament or combinations thereof. Such structures have heretofore been proven satisfactory for backpack frames. It will be appreciated that other materials may also be utilized to fabricate the carrier frame according to the principles of the present invention. It is preferred that the materials utilized be rigid yet lightweight and have a degree of flexibility to withstand normal use of storage in a vehicle. Further, it is preferred that the materials utilized be able to withstand the corrosive atmosphere of salt water, wind, sand and sun of the shore environment.

There is provided on the carrier apparatus a bed upon which objects such as a sailboard, and related attachments may be mounted. Padding is attached to at least the upper surface of the bed to protect any mounted object. Vertical support members are attached to the bed members and angled to intersect shoulder support members. Padding is provided on the underside of the shoulder support members to aid in the distribution over the upper surface of the shoulder of the weight of the carrier apparatus ladened with mounted objects.

Handles mounted on the front vertical support members are provided within comfortable reach of the user. After the object is mounted on the carrier frame apparatus and hefted upon the shoulders of the user, the handles may be grasped by the user to steady the load.

Certain embodiments of the carrier frame apparatus according to the principles of the present invention utilize hinged attachments of the members. In such an application, the carrier frame apparatus may be folded flat before storing.

BRIEF DESCRIPTION OF THE DRAWING

The above and other embodiments of the present invention may be more fully understood from the following detailed description, taken together with the accompanying drawing, wherein similar reference characters refer to similar elements throughout, and in which:

FIG. 1 represents a perspective view of the carrier apparatus;

FIG. 2 represents a perspective view in the open position of an embodiment of the carrier apparatus which may be folded;

DESCRIPTION OF A PREFERRED EMBODIMENT

Figure 3:
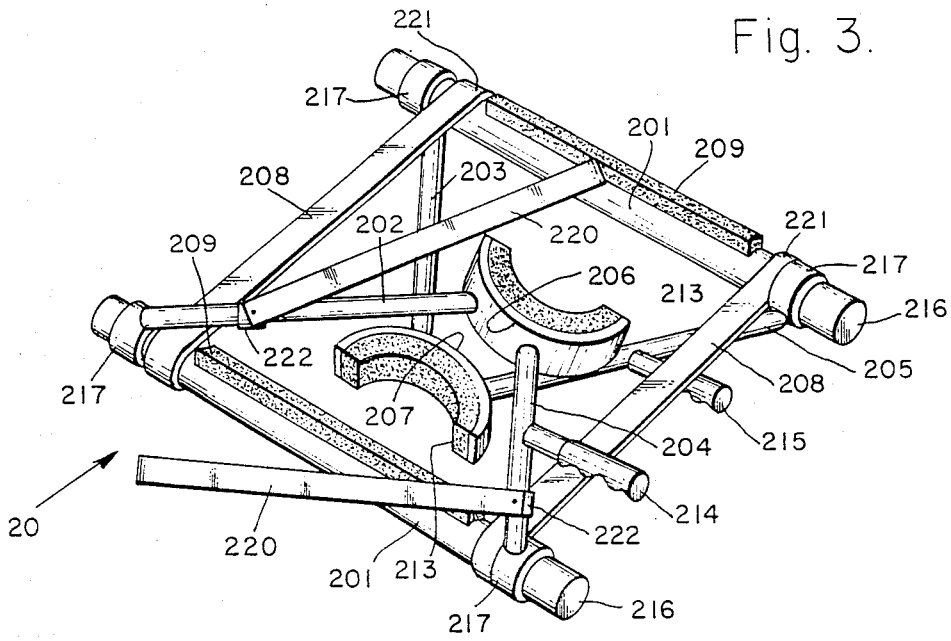
FIG. 3 represents a perspective view of the closed position of the embodiment shown in FIG. 2.

Referring now to the drawing, there is illustrated in FIG. 1 a perspective view of the carrier apparatus 10. The carrier 10 has a bed means fabricated from a plurality of horizontal bed support members 101. Each of the horizontal bed support members 101 has a bed padding member 109 adhesively attached to the upper portion which protects an object mounted upon the carrier apparatus 10. The first end of the right rear vertical support member 102 is attached to the rear portion of the right most of the horizontal bed support members 101 at a preselected angle. The angle is selected to be in the range of 30 to 60 degrees. In the preferred embodiment, the angle for the rear is 40 degrees. The first end of the right front vertical support member 104 is mounted upon the front portion of the right most of the horizontal bed support members 101 at a preselected angle at a point displaced from the right rear vertical support member 102. The angle is in the range of 30 to 60 degrees and is complementary to the angle selected for the right rear vertical support member 102 so that the right rear vertical support member 102, the right front vertical support member 104 and the right most of the horizontal bed support members 101 approximate a triangle.

The right curved shoulder support 106 is mounted to the second end of the right front vertical support member 104 and the second end of the right rear vertical support member 102 at the angle of the triangle opposite the right most of the horizontal bed support members 101. The right shoulder padding 112 is adhesively mounted on the underside of the right curved shoulder support. The right curved shoulder support 106 and attached right shoulder padding 112 are of a width preselected to comfortably distribute, over the shoulder of the user, the weight of the carrier apparatus 10 and objects mounted thereon.

The first end of the left rear vertical support member 103 is mounted on the rear portion of the left most of the horizontal bed support members 101 in a manner similar to the mounting of the right rear vertical support member 102 described above. The first end of the left front vertical support member 105 is mounted on the front portion of the left most of the horizontal bed support members 101 in a manner similar to the mounting of the right rear vertical support member 104. The left curved shoulder support 107 is mounted to the second ends of the vertical support members 103 and 102 opposite the left most horizontal bed support members 101 and the left shoulder padding 113 is adhesively mounted on the underside of the left curved shoulder support 107.

A plurality of bed cross members 108 are attached by the first end to preselected points on the right most of the horizontal bed support members 101. A plurality of support cross members 120; having a first and second end are attached by the first end the right rear vertical support member 102 and attached by the second end to the left rear vertical support member 103. A plurality of support cross members 120 are attached by the first end to the right front vertical support member 104 and attached by the second end to the left front vertical support member 105.

The second end of each of the above bed cross members 108 is attached to a corresponding point on the left most of the horizontal bed support members 101.

The right handle 110 is attached to the right front vertical support member 104 at a point 3 to 5 inches, as measured vertically, above the right curved shoulder support 106. In the preferred embodiment, the right handle 110 is mounted at a distance of 4 inches which is within the comfort zone for a human body to grasp an object to the front of and above the top of the shoulder. The right hand grip 114 is slip mounted over the end of the right handle 110 remote from the right front vertical support member.

The left handle 111 is mounted on the left front vertical support member 105 in a manner similar to the mounting of the right handle 110 described above. The left hand grip 115 is slip mounted over the exposed end of the left handle 111.

A plurality of end caps 116 are inserted into any exposed end of members such as the plurality of horizontal bed support members 101.

There is illustrated in FIG. 2 a perspective view of another embodiment of the carrier apparatus 20 which may be folded flat for storage or transportation.

At least the first end 219 of the support cross member 220 is detachably attached onto the left front vertical support member 205. The first end 219 may be curved to snap fit over the front vertical support member 204 so that the first end 219 is detachable. The first end 219 may be curved, tapped and have a thumb screw inserted into the tap to secure the first end 219 in place around the front vertical support member 204. The second end of the support cross member 220 may be hingedly attached to the right front vertical support member 204.

At least the first end 219 of the support cross member 220 mounted with a thumb screw or a curved end that snap fits onto the left rear vertical support member 203 is detachable. The second end of the support cross member 220 may be hingedly attached to the right rear vertical support member 202.

After detachment of at least the first end 219, the support cross members 220 may be folded into the plane of the front vertical support member and the rear vertical support member 208.

The vertical support members may be hingedly attached to the horizontal bed support members 201 so that the left vertical support members attached to the left shoulder support 206 may be folded to a position parallel to the plurality of horizontal bed support members 201 and the right vertical support members attached to the right shoulder support 206 may be folded to a position parallel to the plurality of horizontal bed support members 201 as shown in FIG. 3.

Strap means may be used to tie the cargo to the bed means.

The foldable carrier apparatus 20 may be fabricated with the right most and left most horizontal bed support members 201 hingedly attached to the bed cross members 208 and the vertically support members rigidly attached to the right and left most horizontal support members 201. Thereby, upon detachment of the support cross members 220 attached to the vertical support members may be folded into a plane parallel to the plurality of horizontal bed support members 201.

Figure 5:
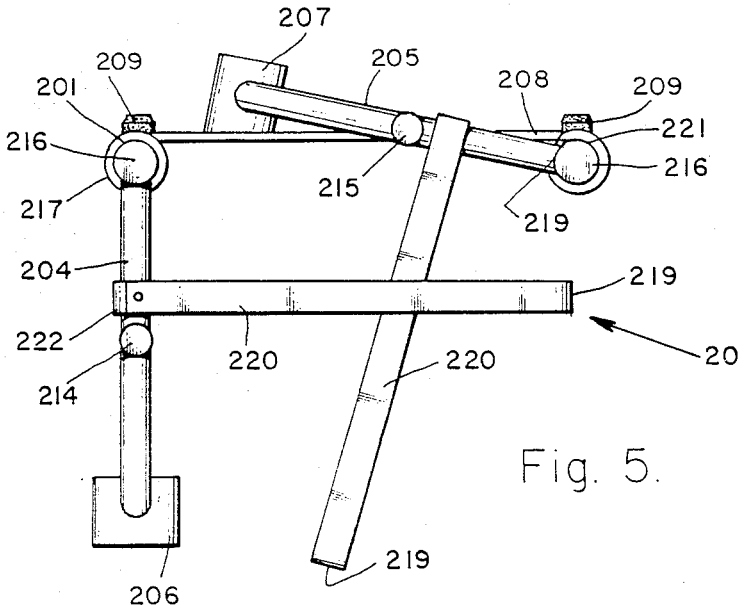
FIG. 5 represents a front view of a partially folded view of the carrier apparatus shown in FIG. 2.

FIG. 5 shows a front view of the foldable carrier apparatus 20 with the end 219 of the support cross member 220 detached from the front vertical support member 205. Not shown is the detachment of the end 219 of the support cross member 220 from the rear vertical support member 203.

The first ends 217 of the bed cross members 208 are curved around the right most horizontal bed support member 201 in a loose fit which allows the right most horizontal bed support member 201 to rotate. The second ends 221 the bed cross members 208 are curved around the left most horizontal bed support member 209 in a loose fit which allows the left most horizontal bed support member 209 to rotate. The vertical support members are rigidly fixed to the rotatable horizontal bed support members. FIG. 5 shows the entire left vertical support structure rotated counterclockwise to become approximately parallel to the bed structure.

The first end 222 of the support cross member 220 is curved around the right front vertical support member 204 in a loose fit which allows the support cross member 220 to be rotated toward the right vertical support structure. The entire right vertical support structure can then be rotated counterclockwise to fold under and become approximately parallel to the bed structure.

Figure 4:
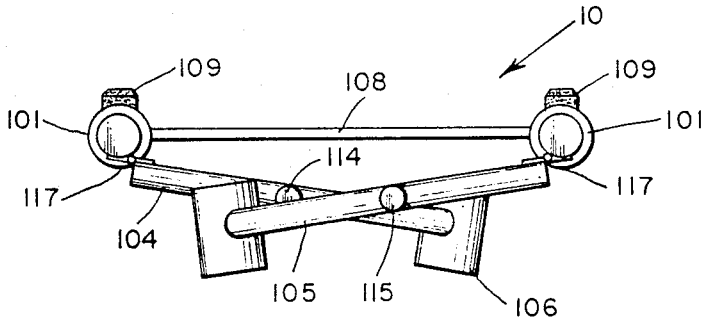
FIG. 4 represents a folded front view of the carrier apparatus depicted in FIG. 1.

FIG. 4 shows the front view of the carrier apparatus 10 shown in FIG. 1. The hinges 117 attaching the vertical members to the horizontal members allows the entire right vertical structure to be rotated counterclockwise to fold under and become approximately parallel to the bed structure. The left vertical structure can then be rotated clockwise to fold under and become approximately parallel to the bed structure.

This concludes the description of a preferred embodiment of the present invention. Those skilled in the art may find many variations and adaptions falling within the scope of this invention, and the appended claims are intended to cover all such variations and adaptions falling within the true scope and spirit of the invention.

What is claimed is:

1. An arrangement for transporting cargo adapted to be placed on the upper surface of both shoulders of a user with the users head positioned below the cargo a sufficient distance to allow the head of the user mobility, comprising, in combination:

a bed means, having a surface upon which said cargo may be loaded, having a plurality of horizontal support members, each having a front end and a rear end, and a plurality of bed cross members each having a right end and a left end and attached to said horizontal support members whereby said bed means has a right front portion, a left front portion, a right rear portion and a left rear portion and a left most and a right most horizontal support member;

a plurality of vertical support members each having a first and a second end and at least the first of said plurality of vertical support members attached at a preselected angle by said first end to said right front portion, at least the second of said plurality of vertical support members attached at a preselected angle by said first end to said left front portion, at least the third of said plurality of vertical support members attached at a preselected angle by said first end to said right rear portion and at least the forth of said plurality of vertical support members attached at a preselected angle by said first end to said left rear portion of said bed means whereby said plurality of vertical support members support said bed means above the head of the user;

a plurality of support cross members each having a first end and second end;

at least the first of said plurality of support cross members attached by said first end to a preselected portion of said at least first vertical support member attached to said right front portion of said bed means and attached by said second end to a preselected portion of said at least second vertical support member attached to said left front portion of said bed means;

at least a second of said plurality of support cross members attached by said first end to a preselected portion of said at least third vertical support member attached to said right rear portion of said bed means and attached by said second end to a preselected portion of said at least fourth vertical support member attached to said left rear portion of said bed means;

whereby said plurality of support cross members keep said plurality of vertical support members in a fixed preselected relation;

a left shoulder support means having an upper and a lower surface, said upper surface connected to said second end of said at least second vertical support member attached to said left front portion of said bed means and connected to said second end of said at least forth vertical support member attached to said left rear portion of said bed means;

a right shoulder support means having an upper and a lower surface, said upper surface connected to said second end of said at least first vertical support member attached to said right front portion of said bed means and connected to said second end of said at least third vertical support member attached to said right rear portion of said bed means;

a right handle mounted on the front most of said at least first vertical support member attached to said right front portion of said bed means; and a left handle mounted on the front most of said at least second vertical support member attached to said left front portion of said bed means.

2. The arrangement defined in claim 1 wherein:

at least the second of said ends of said plurality of support cross members is detachably attached to said at least second vertical support member attached to said left front portion of said bed means; and, at least the second of said ends of said plurality of support cross members is detachably attached to said at least fourth vertical support member attached to said left rear portion of said bed means.

3. The arrangement defined in claim 2 wherein:

the first end of said plurality of support cross members is each hingedly attached to said at least first and third vertical support members attached to said bed means.

4. The arrangement defined in claim 2 wherein:

said first end of each of said at least first, second, third and forth vertical support members is hingedly attached to said bed means whereby under the condition of detachment of at least said detachably attached second end of said support cross members from said vertical support members, the vertical support members may be folded parallel to said bed means.

5. The arrangement defined in claim 2 wherein:

said right most and the left most horizontal support members of said bed means are hingedly attached to said plurality of bed cross members whereby under the condition of detachment of at least said detachably attached second end of said support cross members from said vertical support members, the vertical support members may be folded parallel to said bed means.

6. The arrangement defined in claim 1 wherein:

each said shoulder support means is a curved plate of a preselected width and having a concave lower surface.

7. The arrangement defined in claim 1 wherein:

padding is adhesively mounted on the lower surface of each of the shoulder support means.

8. The arrangement defined in claim 1 wherein:
bed padding is adhesively mounted on the surface of said bed means upon which the cargo is loaded.

9. The arrangement defined in claim 1 additionally comprising:
strap means to tie said cargo to said bed means.

10. An arrangement for transporting cargo adapted to be placed on the upper surface of both shoulders of a user with the users head positioned below the cargo a sufficient distance to allow the head of the user mobility, comprising, in combination:

a bed means, having a surface upon which said cargo may be loaded, having a plurality of horizontal support members, each having a front end and a rear end, and a plurality of bed cross members each having a right end and a left end and attached to said horizontal support members whereby said bed means has a right front portion, a left front portion, a right rear portion and a left rear portion and a left most and a right most horizontal support member;

bed padding adhesively mounted on the surface of said bed means upon which the cargo is loaded;

a plurality of vertical support members each having a first and a second end and at least the first of said plurality of vertical support members attached at a preselected angle by said first end to said right front portion of said bed means, at least the second of said plurality of vertical support members attached at a preselected angle by said first end to said left front portion of said bed means, at least the third of said plurality of vertical support members attached at a preselected angle by said first end to said right rear portion of said bed means and at least the forth of said plurality of vertical support members attached at a preselected angle by said first end to said left rear portion of said bed means whereby said plurality of vertical support members support said bed means above the head of the user;

a plurality of support cross members each having a first end and a second end;

at least the first of said plurality of support cross members attached by said first end to a preselected portion of said at least first vertical support member attached to said right front portion of said bed means and attached by said second end to a preselected portion of said at least second vertical support member attached to said left front portion of said bed means;

at least a second of said plurality of support cross members attached by said first end to a preselected portion of said at least third vertical support member attached to said right rear portion of said bed means and attached by said second end to a preselected portion of said at least fourth vertical support member attached to said left rear portion of said bed means;

whereby said plurality of support cross members keep said plurality of vertical support members in a fixed preselected relation;

a left shoulder support means fabricated in the shape of a curved plate of a preselected width having an upper surface and a lower concave surface, said upper surface connected to said second end of said at least second vertical support member attached to said left front portion of said bed means and connected to said second end of said at least fourth vertical support member attached to said left rear portion of said bed means;

padding adhesively mounted on the lower surface of the left shoulder support means;

a right shoulder support means fabricated in the shape of a curved plate of a preselected width having an upper surface and a lower concave surface, said upper surface connected to said second end of said at least first vertical support member attached to said right front portion of said bed means and connected to said second end of said at least third vertical support member attached to said right rear portion of said bed means;

padding adhesively mounted on the lower surface of the right shoulder support means;

a right handle mounted on the front most of said at least first vertical support member attached to said right front portion of said bed means; and a left handle mounted on the front most of said at least second vertical support member attached to said left front portion of said bed means; and, strap means to tie said cargo to said bed means.

11. The arrangement defined in claim 10 wherein:
at least the second of said ends of said plurality of support cross members is detachably attached to said at least second vertical support member attached to said left front portion of said bed means; and, at least the second of said ends of said plurality of support cross members is detachably attached to said at least fourth vertical support member attached to said left rear portion of said bed means.

12. The arrangement defined in claim 11 wherein:
the first end of said plurality of support cross members is each hingedly attached to said at least first and third vertical support members attached to said bed means.

13. The arrangement defined in claim 11 wherein:
said first end of said at least first, second, third and fourth vertical support members is hingedly attached to said bed means whereby under the condition of detachment of at least said detachably attached second end of said support cross members from said vertical support members, the vertical support members may be folded parallel to said bed means.

14. The arrangement defined in claim 12 wherein:
the right most and the left most horizontal support member of said bed means are hingedly attached to said plurality of bed cross members whereby under the condition of detachment of at least said detachably attached second end of said support cross members from said vertical support members, the vertical support members may be folded parallel to said bed means.

* * * * *